US007257335B1

(12) United States Patent
Chan

(10) Patent No.: US 7,257,335 B1
(45) Date of Patent: Aug. 14, 2007

(54) UNIVERSAL SMART CHIP CARTRIDGES FOR MULTIPLE PRINTING APPARATUS

(75) Inventor: Alan K. Chan, Fairport, NY (US)

(73) Assignee: Nu-kote International, Inc., Franklin, TN (US)

( * ) Notice: Subject to any disclaimer, the term of this patent is extended or adjusted under 35 U.S.C. 154(b) by 161 days.

(21) Appl. No.: 11/015,103

(22) Filed: Dec. 17, 2004

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS

| | | | | |
|---|---|---|---|---|
| 5,235,384 | A | 8/1993 | Oka et al. | |
| 5,975,688 | A | 11/1999 | Kanaya et al. | |
| 6,181,885 | B1 | 1/2001 | Best et al. | |
| 6,339,684 | B1 | 1/2002 | Sato et al. | |
| 6,655,779 | B2 | 12/2003 | Usui et al. | |
| 6,672,695 | B1 * | 1/2004 | Naka et al. | 347/7 |
| 7,014,301 | B2 | 3/2006 | Dentel et al. | |
| 7,088,928 | B2 | 8/2006 | Burchette et al. | |
| 2002/0135655 | A1 | 9/2002 | Ameyama et al. | |
| 2004/0101320 | A1 | 5/2004 | Haramoto | |
| 2004/0212651 | A1 | 10/2004 | Johnson et al. | |
| 2006/0069824 | A1 * | 3/2006 | Hodder | 710/72 |

FOREIGN PATENT DOCUMENTS

| | | |
|---|---|---|
| JP | 60083046 | 5/1985 |
| JP | 03105402 | 5/1991 |
| JP | 04070675 | 3/1992 |
| JP | 2003-084631 A | 3/2003 |

* cited by examiner

*Primary Examiner*—Vincent Q. Nguyen
(74) *Attorney, Agent, or Firm*—Fay Sharpe LLP

(57) ABSTRACT

A printing system includes first and second printing devices operable exclusively with respective first and second consumable devices. A third consumable device is provided in the system storing identification data recognizable by both the first and second printing devices whereby the third consumable device is operable with both the first and second printing devices. Further, the universal marking material cartridge is provided for use in associated printing system including first and second printing devices operable exclusively with respective first and second consumable devices. The universal marking material cartridge stores identification data recognizable by both first and second printing devices whereby the cartridge is operable with both of the printing devices.

10 Claims, 4 Drawing Sheets

UNIVERSAL SMART CHIP CARTRIDGES FOR MULTIPLE PRINTING APPARATUS

BACKGROUND OF THE INVENTION

This application relates to universal cartridges for use with printing apparatus having cartridge interlock functions which prevent the unauthorized use of non-specified cartridges in selected printing apparatus. More particularly, the subject application relates to ink and toner cartridges having universal application in two or more different printers, each having different cartridge interlock requirements. It will be appreciated, however, that the invention may find application in related environments and applications where interlock functions are used to establish a limitation on a range of cartridges compatible with the printers.

It is generally known in the art to provide ink or toner cartridges with electronic devices storing certain unique cartridge identification codes which limit the use of particular cartridges to particular printing apparatus. Functionally, if the identification codes stored in the electronics on the cartridge do not match the code or codes expected by the printing apparatus, printer function is inhibited. Typically, the electronic storage devices applied to the cartridge bodies are interrogated during printer power-up sequences using well-know techniques to retrieve a variety of data stored in the electronics contained on the cartridge body into circuitry residing the printing apparatus. Some cartridges include information relating to the quantity of ink or toner material contained within the cartridge housing, certain performance characteristics of the marking material itself, a date of manufacture, and other information together with the unique cartridge identification codes.

In some situations, it is desirable to use a single cartridge type across multiple printing apparatus platforms. However, it is difficult to accomplish this goal when each of the individual printer apparatus platforms have different unique cartridge identification code requirements.

Accordingly, it is desirable to provide a cartridge having data contained therein which is compatible with two or more dissimilar printing apparatus, each having different unique cartridge identification code requirements. Such a cartridge would fulfill a long-felt need for a reduction in the number of SKUs

SUMMARY OF THE INVENTION

The present invention teaches the universal marking of material cartridge for use in a printing system, the cartridge including a housing holding a marking material for depositing the marking material onto an associated substrate. The subject universal marking material cartridge stores identification data which is compatible with a set of predetermined identification data items stored in a plurality of associated printing apparatus different types or models. In a preferred embodiment, the identification data stored in the universal marking material cartridge is compatible with at least a first predetermined set of identification data stored in a first set of associated printing apparatus and is further compatible with a second predetermined set of identification data stored in a second set of associated printing apparatus. In that way, the universal marking material cartridge is operable with both said first set of printing apparatus as well as said second set of printing apparatus.

One advantage of the universal marking material cartridge of the present application is the ability of a single universal cartridge type to be used across multiple printer product lines.

In accordance with another aspect of the present invention, a printing system is disclosed including first and second printing devices each being operable with respective first and second consumable devices holding marking material. The first consumable device is operable only with the first printing device by means of a correspondence check between first identification data stored in first consumable device compared against predetermined identification data stored in the first printing device. Similarly, the second consumable device is operable only in the second printing device by means of a correspondence verification check of second identification data stored on the second consumable device against predetermined second identification data stored in the second printing device. The third consumable device in the printing system holds marking material and the third identification data which is compatible with both of said first and second predetermined identification data stored respectively in the first and second printing devices of the system. In that way, the third consumable device is operable with both the first printing device as well as the second printing device. In that way, users having a plurality of diverse printing apparatus can use a single consumable device holding marking material, thus reducing inventory and lower the costs.

Still other advantages and benefits of the invention will become apparent to those skilled in the art upon reading and understanding the following detailed description.

BRIEF DESCRIPTION OF THE DRAWINGS

The invention may take form in certain components, structures, and steps, the preferred embodiments of which will be illustrated in the accompanying drawings.

DETAILED DESCRIPTION

Figure 1:
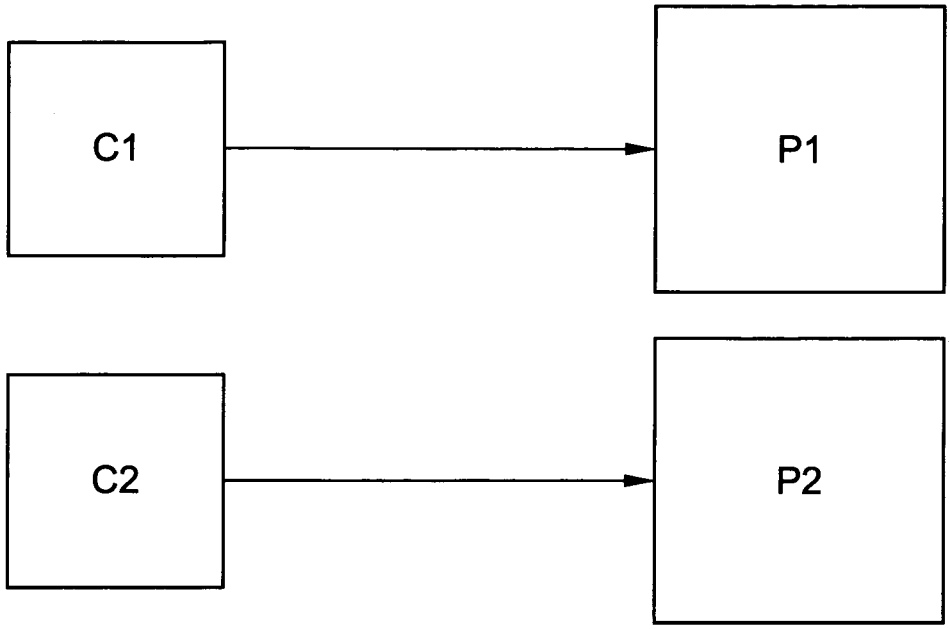
FIG. 1 (PRIOR ART)
FIG. 1 is a block diagram of a prior art printing system including a pair of printing devices and a pair of cartridges.

With reference now to FIG. 1, a printing system 1 formed in accordance with the prior art is illustrated. As shown there, the printing system includes a first printing device P1 operable with a corresponding printing cartridge C1. Correspondingly, the system 1 includes a second printing device P2 operable with a corresponding printing cartridge C2. In the prior art system illustrated, electronic storage device (not shown) are applied to the cartridges C1, C2 and are interrogated during printer power-up sequences or the like using well known techniques to retrieve a variety of data stored in the electronic contained on the cartridges into circuitry residing in the printing apparatus P1, P2.

In the prior art system illustrated, each of the cartridges C1, C2 stores interlock data preventing the first cartridge from use with printers other than the first printing device P1 and, similarly, preventing second cartridge C2 from use with printers other than the second printing device P2. Simply, the first cartridge C1 is compatible or operable with the first printing device P1, exclusively. Similarly, the second cartridge C2 is operable with the second printing device P2, exclusively.

Figure 2:
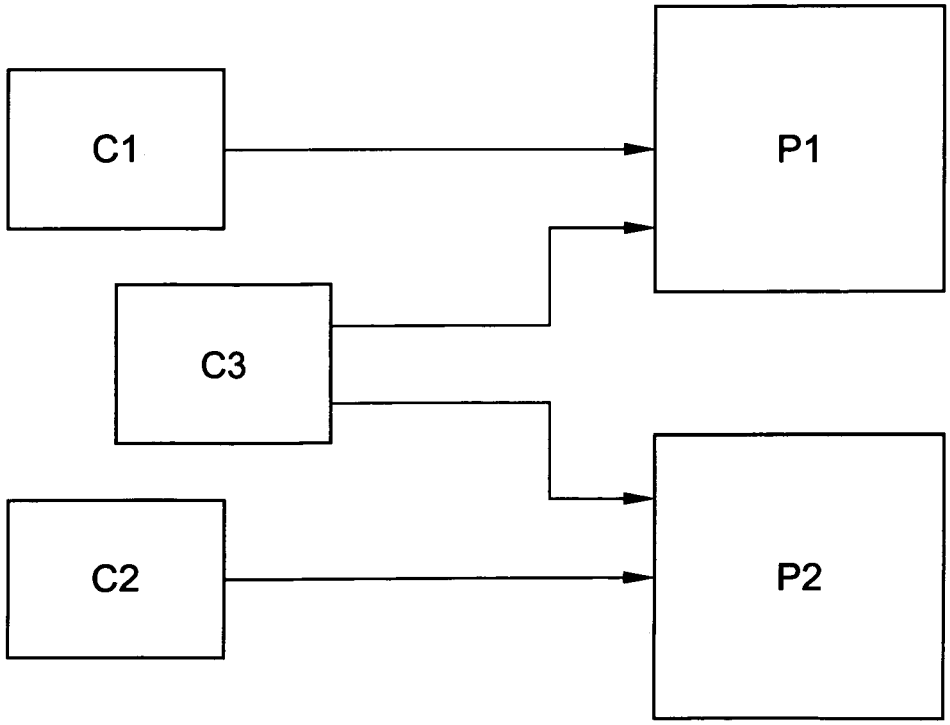
FIG. 2 is a block diagram illustrating a printing system formed in accordance with a first embodiment of the present invention.

FIG. 2 illustrates a printing system 10 formed in accordance with a first embodiment of the present invention. As shown there, the printing system 10 includes a first printing device P1 operable with an associated first consumable device C1. A second printing device P2 is operable with an associated second consumable device C2. Lastly, the printing system 10 also includes a third consumable device C3 operable with both the first printing device P1 and the second printing device P2. It is to be appreciated that the printing system 10 illustrated in FIG. 2 overcomes the disadvantages of the prior art because the third consumable device C3 is operable with both printing devices P1, P2.

Figure 3:
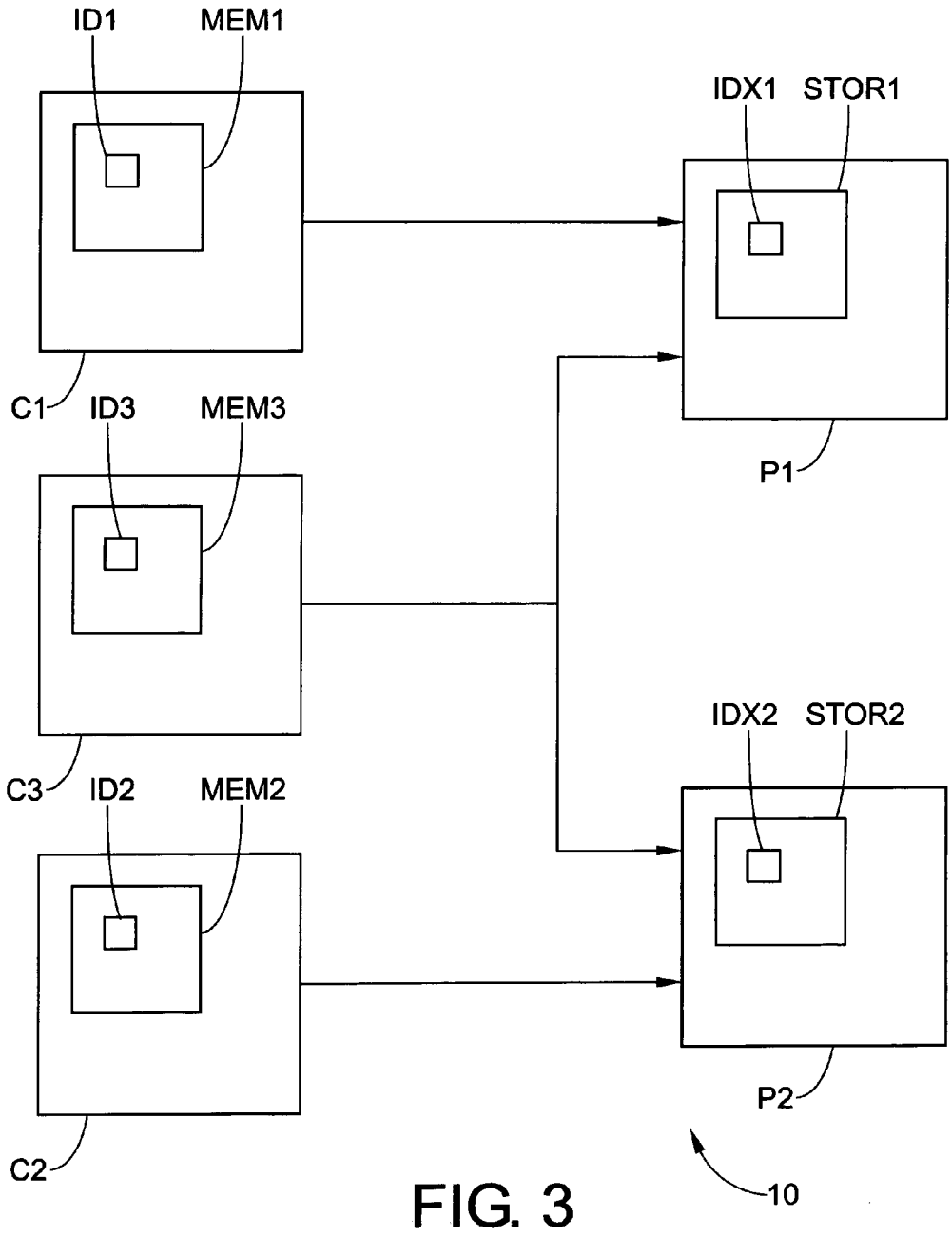
FIG. 3 is a block diagram providing additional details to the system illustrated in FIG. 2.

With continued references to FIG. 2 but with additional reference to FIG. 3, the first consumable device P1 stores identification data ID1 in a first memory MEM1 and holds first marking material for depositing the first marking material onto an associated substrate (not shown). The first printing device P1 is attempting to read the first identification data ID1 and compare the first identification data with a first predetermined set of identification data IDX1 stored in a first storage STOR1. Further, the first printer P1 is adapted to prevent depositing of the marking material from the first consumable device C1 onto the associated substrate if the first identification data ID1 does not match the first predetermined set of identification data IDX1.

Similar to the above, the second printing device P2 is operable with the second consumable device C2 which holds second marking material for depositing the second marking material onto an associated substrate (not shown). The second consumable device C2 stores second identification data ID2 in a second memory MEM2. The second printing device P2 is adapted to read the second identification data ID2 and compare the second identification data with a second predetermined set of identification data IDX2 held in a second storage STOR2. The second printing device P2 is adapted to prevent depositing of the second marking material onto the associated substrate when the second identification data ID2 does not match the second predetermined set of identification data IDX2.

Further, a third consumable device C3 is provided in the printing system 10 and holds a third marking material for depositing the third marking material onto an associated substrate. The third consumable device C3 stores third identification data ID3 in a third memory MEM3, a third identification data being compatible with at least one of the first predetermined set of identification data IDX1 in the first printing device P1 and at least one of the second predetermined set of identification data IDX2 held in the second printing device P2. In that way, the third consumable device C3 is operable with both the first printing device P1 as well as the second printing device P2.

It is to be appreciated that the identification data ID1–ID3 is stored on the consumable devices C1–C3 using well known data storage techniques such as, for example, using a semiconductor memory device. Other means for storing identification data on the cartridges are available as well including mechanical tabs, radio frequency identification (RFID) tags, bar codes, optical reflectors, magnetic tapes, or any other means for storing a code on or in the cartridge for identifying the cartridge.

It is to be further appreciated that the consumable devices C1–C3 are adapted to store ink, toner, or any other marking material which can be deposited on a substrate. Although toner and ink are contemplated in the preferred embodiments in the instant application, the present system is useful with any substance or product which can be held in a container and selectively released or ejected therefrom.

Figure 4:
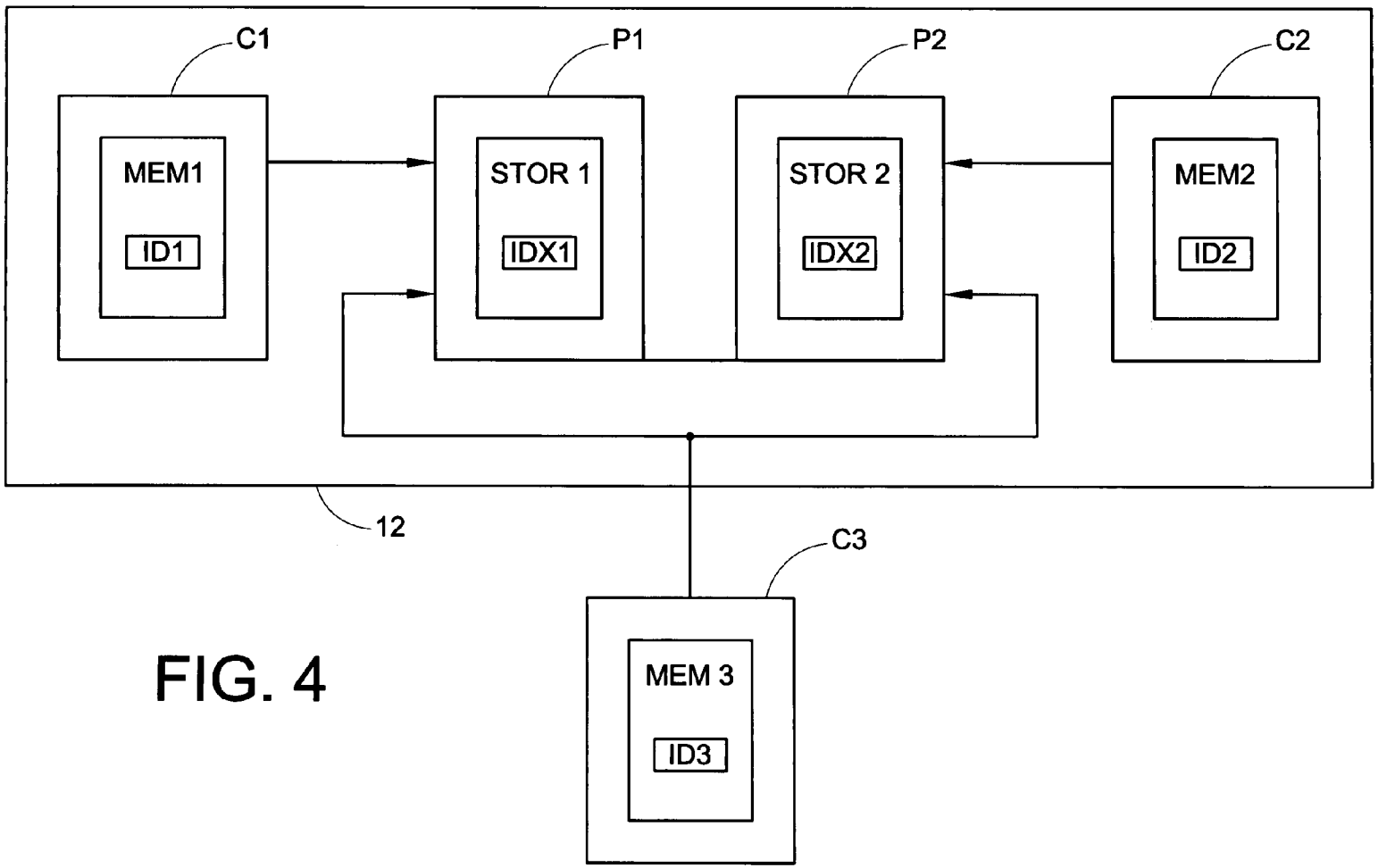
FIG. 4 is a block diagram illustrating a universal marking material cartridge formed in accordance with a second embodiment of the invention; and, FIGS. 5*a*–5*c* are block diagrams showing an exemplary identification data storage scheme.

FIG. 4 illustrates a universal marking material cartridge formed in accordance with a second preferred embodiment of the invention. As shown there, the universal marking material cartridge C3 is adapted for use in a printing system 12 including first and second printing devices P1, P2. The first printing device P1 is operable with an associated first consumable device C1 holding a first marking material for depositing the first marking material onto an associated substrate (not shown). The first consumable device C1 stores first identification data ID1 and the first printing device P1 is adapted to read the first identification data ID1 and compare the first identification data with a first predetermined set of identification data IDX1. The first printing device P1 prevents depositing of the marking material onto the associated substrate when the first identification data ID1 does not match the first predetermined set of identification data IDX1.

The printing system 12 further includes an associated second consumable device C2 holding a second marking material for depositing onto an associated substrate (not shown). The second consumable device C2 stores second identification data ID2 and the second printing device P2 is adapted to read the second identification data and compare the second identification data with a second predetermined set of identification data IDX2. The second printing device P2 is adapted to prevent the depositing of the marking material onto the substrate when the second identification data ID2 does not match the second predetermined set of identification data IDX2.

The universal marking material cartridge C3 formed in accordance with the second embodiment of the invention is adapted for use in the printing system 12 described above. The universal marking material cartridge C3 includes a housing holding a third marking material for depositing onto an associated substrate. The cartridge C3 stores third identification data ID3. In its preferred form, the third identification data ID3 matches at least one of the first predetermined set of identification data IDX1 in the first printing device P1 and at least one of the second predetermined set of identification data IDX2 stored in the second printing device P2. In that way, the universal marking material cartridge C3 of the second embodiment is operable with the associated printing system including both said first and second printing devices P1, P2. In that way, the single universal marking material cartridge C3 can be used as an installation, corporation, or the like having a wide range of diverse printing apparatus.

Figure 5A:
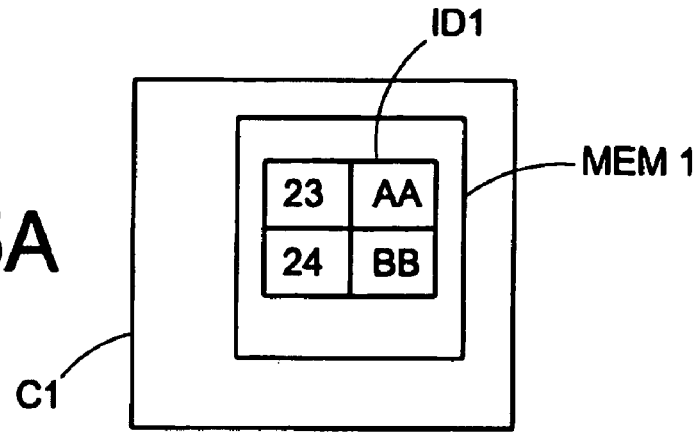
Figure 5B:
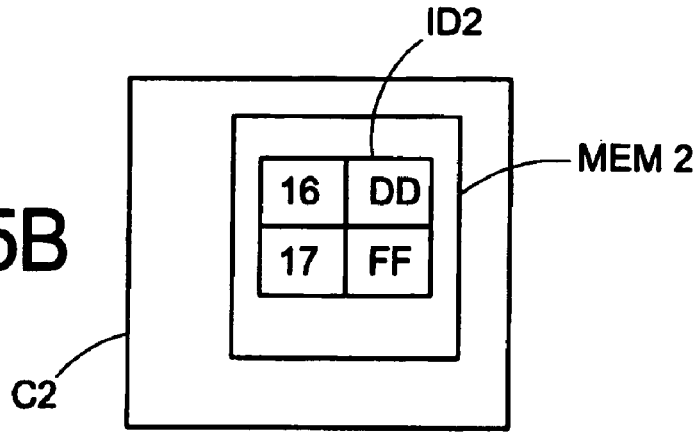
Figure 5C:
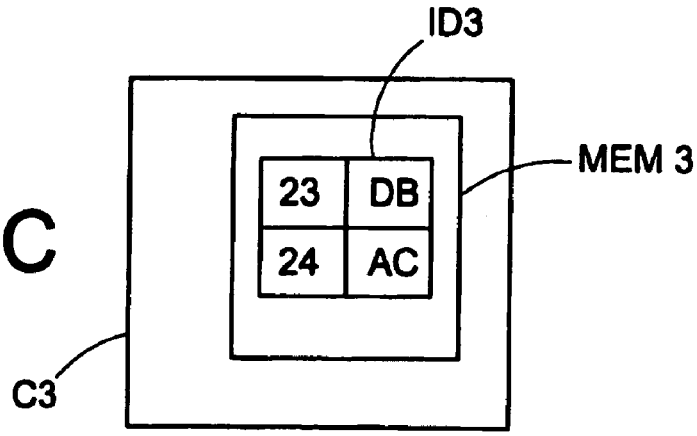

Turning next to FIGS. 5*a*–5*c*, exemplary data storage schemes are illustrated. In FIG. 5*a*, the first consumable device C1 includes first identification data ID1 stored in a first memory device MEM1. In the exemplary embodiment illustrated, the first identification data ID1 is two 8-bit data having 16 bits stored in a pair of 8 bit locations. The first 8-bit data is stored in memory location 23 and the second 8-bit data of the first identification data ID1 is stored in a second memory location 24. In the exemplary showing of FIG. 5*a*, the first identification data ID1 is "AA" and "AB" stored in memory locations 23 and 24.

In FIG. 5*b*, a second identification ID2 with a value of "DD" and "FF" are stored in memory locations 16 and 17 in memory device MEM2 for the second consumable device C2. As described above, the second printing device P2 in the embodiments described above interrogate the second consumable device C2 for comparing the second identification data "DD" and "FF" with a second set of identification data stored in the second printing device.

FIG. 5*c* shows an exemplary data storage scheme used in the third consumable device C3 of the first embodiment and the universal marking material cartridge C3 of the second embodiment. As shown there, the cartridge identification data "DB" and "AC" are stored at memory locations 23 and 24 in memory device MEM3. As described above, the stored identification data ID3 is recognized by both said first and second printing apparatus P1, P2 whereby the third and universal cartridges, C3 are operable with both the first and second printing devices P1, P2.

It is also to be understood and appreciated that the identification data ID3, and the storage memory locations in memory device MEM3 for identification ID3, that reside on the third consumable device C3 can be any number of bytes or words, and in any memory locations within the memory storage device, are not limited to the two bytes and two memory locations as illustrated on FIGS. 5*a*–5*c*.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A printing system comprising:

a first printing device operable with an associated first consumable device holding a first marking material for depositing the first marking material onto an associated substrate, the first consumable device storing first identification data in a first memory and the first printing device being adapted to read the first identification data, compare the first identification data with a first predetermined set of identification data in a first storage, and prevent said depositing of said first marking material onto the associated substrate when the first identification data does not match said first predetermined set of identification data;

a second printing device operable with an associated second consumable device holding a second marking material for depositing the second marking material onto an associated substrate, the second consumable device storing second identification data in a second memory and the second printing device being adapted to read the second identification data, compare the second identification data with a second predetermined set of identification data in a second storage, and prevent said depositing of said second marking material onto the associated substrate when the second identification data does not match said second predetermined set of identification data; and, a third consumable device holding a third marking material for depositing the third marking material onto an associated substrate, the third consumable device storing third identification data in a third memory, the third identification data being compatible with at least one of said first predetermined set of identification data and at least one of said second predetermined set of identification data, whereby the third consumable device is operable with both said first printing device and said second printing device.

2. The printing system according to claim 1 wherein said third consumable device includes a semiconductor memory device adapted to store said third identification data.

3. The printing system according to claim 2 wherein:

said third consumable device is an ink cartridge;

said third marking material is ink; and, said third identification data is binary data stored in said semiconductor memory device.

4. The printing system according to claim 2 wherein:

said third consumable device is a toner cartridge;

said third marking material is toner; and, said third identification data is binary data stored in said semiconductor memory device.

5. The printing system according to claim 1 further including a plurality of printing devices, each of the plurality of printing devices having a corresponding set of identification data, each said set of identification data having at least one identification data item matching said third identification data whereby said third consumable device is operable with each of said plurality of printing devices.

6. The printing system according to claim 1 wherein:

the first identification data matches at least one of said first predetermined set of identification data and does not match any of said second predetermined set of identification data, whereby said first consumable device is operable with said first printing device and is inoperable with said second printing device; and, said second identification data matches at least one of said second predetermined set of identification data and does not match any of said first predetermined set of identification data, whereby said second consumable device is operable with said second printing device and inoperable with said first printing device.

7. A universal marking material cartridge for use in a printing system including: a first printing device operable with an associated first consumable device holding a first marking material for depositing the first marking material onto an associated substrate, the first consumable device storing first identification data and the first printing device being adapted to read the first identification data, compare the first identification data with a first predetermined set of identification data, and prevent said depositing of said first marking material onto the associated substrate when the first identification data does not match said first predetermined set of identification data; and, a second printing device operable with an associated second consumable device holding a second marking material for depositing the second marking material onto an associated substrate, the second consumable device storing second identification data and the second printing device being adapted to read the second identification data, compare the second identification data with a second predetermined set of identification data, and prevent said depositing of said second marking material onto the associated substrate when the second identification data does not match said second predetermined set of identification data, the universal marking material cartridge comprising:

a housing holding a third marking material for depositing the third marking material onto an associated substrate, the universal marking material cartridge storing third identification data, the third identification data matching at least one of said first predetermined set of identification data and at least one of said second predetermined set of identification data, whereby said universal marking material cartridge is operable with both said first printing device and said second printing device.

8. The universal marking material cartridge according to claim 7 wherein the cartridge further includes a semiconductor memory device adapted to store said third identification data.

9. The universal marking material cartridge according to claim 8 wherein:

said universal marking material cartridge is an ink cartridge;

said third marking material is ink; and, said third identification data is binary data stored in said semiconductor memory device.

10. The universal marking material cartridge according to claim 8 wherein:

said universal marking material cartridge is a toner cartridge;

said third marking material is toner; and, said third identification data is binary data stored in said semiconductor memory device.

* * * * *